US005184755A

United States Patent [19]

Brovelli

[11] Patent Number: 5,184,755

[45] Date of Patent: Feb. 9, 1993

[54] TOY WATER GUN UTILIZING AN AIR PRESSURE PUMP

[75] Inventor: Virginio Brovelli, Taino, Italy

[73] Assignee: Lanard Toys Limited, Kowloon, Hong Kong

[21] Appl. No.: 805,475

[22] Filed: Dec. 11, 1991

[51] Int. Cl.[5] ..... A63H 3/18

[52] U.S. Cl. ..... 222/79; 222/396; 222/401

[58] Field of Search ..... 222/79, 325, 396, 400.7, 222/400.8, 401; 42/54; 446/473; 273/349; 124/70, 73; 239/99

[56] References Cited

U.S. PATENT DOCUMENTS

| | | | |
|---|---|---|---|
| D. 159,040 | 6/1950 | Bicos | 222/79 X |
| 599,383 | 2/1898 | Bunnell | 222/79 |
| 2,049,194 | 7/1936 | Chapin et al. | 222/400.8 X |
| 2,589,977 | 3/1952 | Stelzer | 222/401 |
| 3,005,495 | 10/1961 | Herberg | 222/79 |
| 3,578,789 | 5/1971 | Ferri | 222/79 |
| 4,441,629 | 4/1984 | Mackal | 222/396 X |
| 4,591,071 | 5/1986 | Johnson | 222/401 X |
| 4,630,757 | 12/1986 | Yano | 222/79 |
| 4,743,030 | 5/1988 | Auer et al. | 222/79 |
| 4,757,946 | 7/1988 | Johnson | 239/99 |
| 5,029,732 | 7/1991 | Wong | 222/79 |
| 5,074,437 | 12/1991 | D'Andrade et al. | 222/79 |

FOREIGN PATENT DOCUMENTS

| | | | |
|---|---|---|---|
| 431955 | 7/1935 | United Kingdom | 222/79 |
| 669983 | 4/1952 | United Kingdom | 222/79 |

*Primary Examiner*—Gregory L. Huson
*Attorney, Agent, or Firm*—Brumbaugh, Graves, Donohue & Raymond

[57] ABSTRACT

A toy water gun has a pump/valve subassembly in which a flange plate is affixed to the outlet end of the cylinder member of an air pump. An integral tubular boss extends from the flange plate externally of the cylinder member outlet, the boss serving as the valve body of a discharge control valve. An annular gasket on the perimeter of the flange plate laterally outwardly of the cylinder member and the valve body forms a seal with the neck of a water reservoir, whereby the air pump outlet to the water reservoir and the inlet to the discharge valve communicate directly with the reservoir. A trigger operates the normally closed discharge control valve, and water under pressure is expelled from the reservoir through a discharge tube and nozzle when the trigger is pulled. A pressure-relief valve on the air pump prevents the pump from pressurizing the air pumped into the reservoir to a pressure above a predetermined value.

7 Claims, 3 Drawing Sheets

TOY WATER GUN UTILIZING AN AIR PRESSURE PUMP

BACKGROUND OF THE INVENTION

The present invention relates to a toy water gun and, in particular, to a toy water gun of the type in which air pressure is built up in a water reservoir by an air pump and forces the water out of the gun through a nozzle when a discharge valve is opened. Air pump-type water guns are very much like garden sprayers; they use essentially the same components and operate in the same way. The main difference is that toy water guns have cases that resemble a gun in appearance. The basic elements of both air pump-type water guns and garden sprayers are a reservoir capable of holding water and air under pressure, an air pump for pumping air into the reservoir, a discharge tube with a normally closed control valve in it to keep the liquid from being released from the reservoir except when the valve is opened, and a nozzle for controlling the pattern of the liquid discharged from the discharge tube. Toy water guns are well known in the art from, for example, the following U.S. Pat. Nos.: 2,589,977 (Stelzer, 1949); 4,214,674 (Jones et al., 1980); 4,239,129 (Esposito, 1980); 4,591,071 (Johnson, 1986); and 4,757,946 (Johnson, 1988). A water gun suitable for use as a toy but intended for warding off savage dogs (and vicious persons) is described and shown in U.S. Pat. No. 599,383 (Bunnell et al., 1898).

Despite the fact that toy water guns are relatively simple devices, it is somewhat challenging to designers to construct them in a way that minimizes their mechanical complexity and cost, from the points of view of both production of components and the assembly of the components. That challenge has been met to some extent by products that are currently marketed. However, the prior art air pump-type water guns have employed separate air pumps and discharge valves and separate tubes to connect them, i.e., one to connect the air pump to the reservoir, another to connect the reservoir to the discharge valve and yet another to connect the discharge valve to the nozzle. Each tube requires fittings on the elements to which it is connected, and the connections have to be capable of holding the air pressure at which the gun operates. Also, the tubes have to be individually joined to the reservoir, pump and valve when the water gun is assembled, an operation that is done by hand. Plastic tubing is normally used, and because it is relatively extensible, the fittings must be designed and assembled in a manner that ensures that they will not develop leaks.

SUMMARY OF THE INVENTION

An object of the present invention is to provide an air pump-type water gun that is of a simplified construction in that it has fewer components. Another object is to provide such a water gun in which there is only a single tube that is subject to the pressure difference between the pressure in the reservoir when it is pressurized and the ambient atmospheric pressure. Still another object is to provide an air pump-type water gun that is easier to assemble, thereby reducing the cost of manufacture, than are prior art air pump-type water guns. It is also desired to make it impossible for the water gun to be over-pressurized.

Like previously known toy air pump-type water guns, the water gun of the present invention includes a hollow elongated case having a handle for grasping by a user and a water reservoir that has a neck and is attached to the case at the neck. An air pump, which includes a cylinder member forming a chamber, a piston/piston rod received in the cylinder member, and a one-way valve on the piston, is mounted in the case and communicates through a one-way valve in an outlet end of the cylinder member with the water reservoir such that air under pressure can be pumped into the reservoir by operation of the air pump. A flexible discharge tube leads to a nozzle mounted on the case, and a normally closed discharge control valve is interposed between the water reservoir and the discharge tube, the discharge control valve being operable to enable water to flow from the reservoir through the discharge tube to and out of the nozzle.

One aspect of the improvements, according to the present invention, involve the construction of the air pump and the discharge control valve and the relationship between the air pump, the discharge control valve, and the reservoir. In particular, an air pump-type water gun in accordance with the present invention comprises a flange plate affixed to the outlet end of the cylinder member, an integral tubular boss extending from the flange plate externally of the cylinder member outlet, the boss being a valve body of the discharge control valve, and an annular gasket or other sealing means interposed between the perimeter of the flange plate laterally outwardly of the cylinder member and forming a seal with the neck of the water reservoir, whereby the air pump outlet to the water reservoir and the inlet to the discharge control valve communicate directly with the reservoir. With this arrangement, tubes to connect the air pump to the reservoir and the reservoir to the discharge control valve are eliminated. Furthermore, the air pump and discharge valve can be a sub-assembly of the water gun, which is readily installed at final assembly and which simplifies the design of the case.

In a preferred embodiment, the valve body of the discharge control valve has a valve port opening defined by a valve seat, and the discharge valve includes a valve flow tube slidably supported in the valve body by reception telescopically within a portion thereof and carrying a flow tube gasket adapted to form a seal with the valve seat. A valve flow tube support arm having a guide hole is attached to the cylinder member, and the valve flow tube is slidably supported in the guide hole of the support arm. A compression spring engaged between the support arm and the valve flow tube biases the valve flow tube in a direction to seat the flow tube gasket on the valve seat of the valve body. A trigger engages the valve flow tube and is moveable in a direction to move the valve flow tube against the bias of the compression spring and thereby open the discharge control valve.

In a preferred embodiment, moreover, the cylinder member has a transverse wall located closely adjacent the outlet end and having a hole in it to permit air to flow through it to the outlet end of the cylinder member. A seal retainer disc is received in the cylinder member between the transverse wall and the flange plate. The retainer disc has openings to permit air to flow through it to the outlet end of the cylinder member. The flange plate has an annular flange received within the outlet end of the cylinder member and engaging the retainer disc to hold it in place within the cylinder member, and a flange valve diaphragm is received between the transverse wall and the retainer disc and blocks the flow of air from the reservoir into the cylinder member through the hole in the transverse wall when the pump piston moves away from the outlet end of the cylinder member and permits the flow of air from within the cylinder member through the hole in the transverse wall when the pump piston moves toward the outlet end of the cylinder member.

According to another aspect of the invention, the water gun has a pressure-relief valve communicating with the air pump cylinder member proximate to the outlet end for preventing the pump from pressurizing the air pumped into the water reservoir to a pressure above a predetermined value. In a preferred embodiment, the pressure relief valve includes a port in the cylinder member surrounded by a valve seat, an annular flange surrounding the valve seat, a seal member, and a spring biassing the seal member into sealing engagement with the valve seat and adapted to yield and enable the seal member to unseat from the valve seat when the pressure in the reservoir reaches the predetermined value. By preventing over-pressurizing of the water gun, possible damage to it is avoided. While discharge control valves that open when a certain pressure is built up in the reservoir are known in the prior art from, for example, U.S. Pat. Nos. 599,383 and 4,214,674, the pressure-limiting characteristic of the pressure-relief valve of the water gun of the present invention has the advantage of releasing only air or a spray of water from the flange, rather than a jet of water from the nozzle, which might be accidently misdirected. The discharge from the relief valve is preferably released through a hole in the gun case.

In a preferred embodiment, the air pump and discharge control valve are a self-contained subassembly, which can be assembled remotely from the place of final assembly of the water gun. The ability to install the subassembly in the gun body quickly and easily and the elimination of the need to connect up tubes between the pump and reservoir and the reservoir and the discharge control valve either prior to or at final assembly provide significant savings in labor costs. Moreover, most of the components of the subassembly can be produced economically from suitable polymeric materials by injection-molding in simple two-part molds. The subassembly also permits the case to be of less complexity insofar as the form and number of mounting ribs, grooves and bosses is concerned.

Of particular advantage in the present invention is the direct juncture between the neck of the reservoir and the flange plate of the pump/valve subassembly with a seal between them. As mentioned above, two tubes and four tube couplings, that are common in prior art air pump-type water guns, are eliminated, as are an increased probability of leakage and of defective manufacture. Production and service reliability are both enhanced by the invention.

For a better understanding of the invention, reference may be made to the following description of an exemplary embodiment, taken in conjunction with the accompanying drawings.

DESCRIPTION OF THE EMBODIMENT

Figure 1:
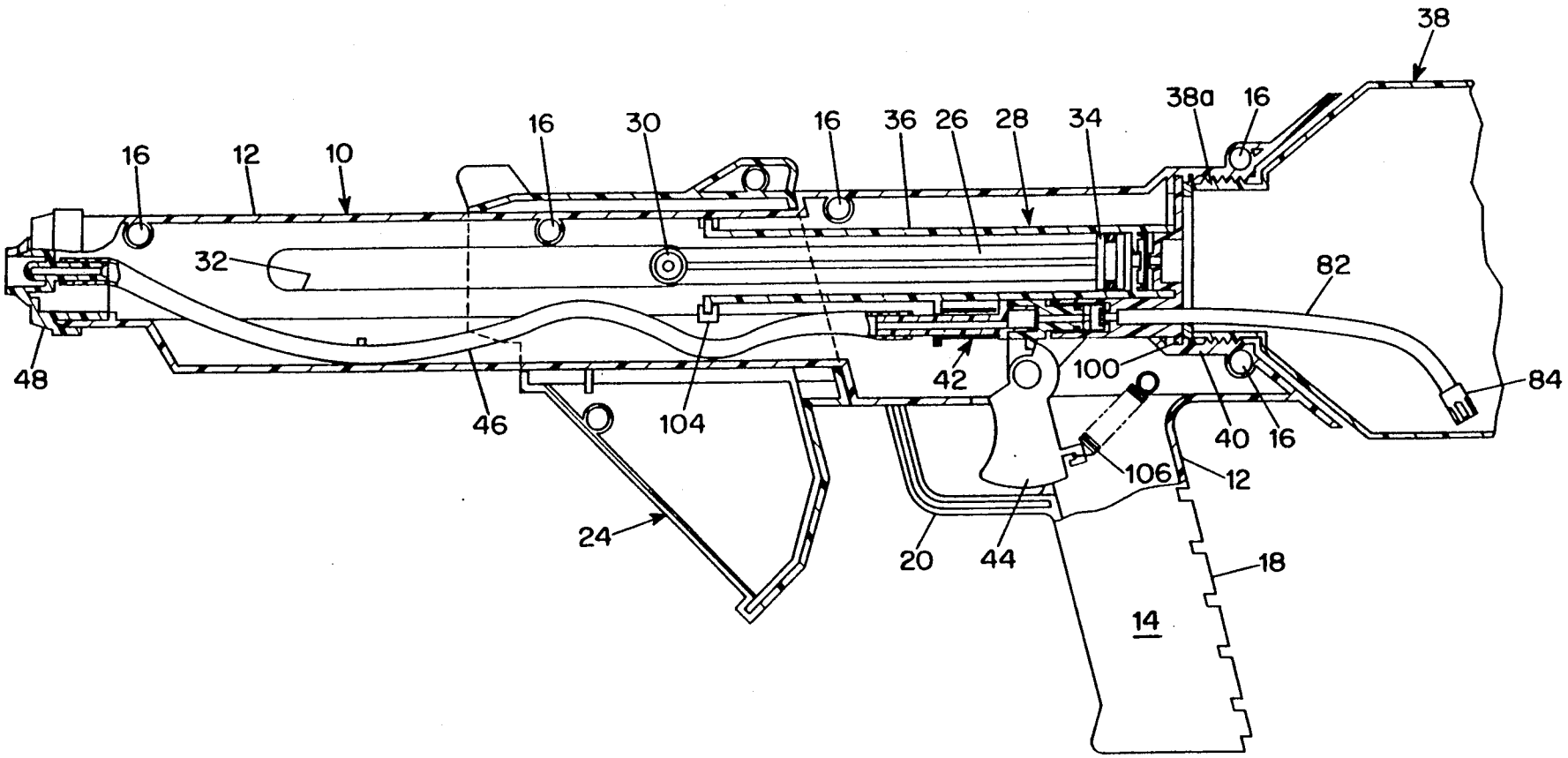
FIG. 1 is a partially simplified side elevational view of the embodiment, parts of the case being broken away to reveal the inner working components.

Like many toys (and other articles for that matter), the embodiment has a hollow case 10 that is composed of two halves 12 and 14 that are placed edge to edge and joined by screws (not shown); the skilled observer will see some of the screw bosses 16 in the case section 12, which is cross-sectioned for clarity. The case 10 includes a barrel portion 18 and a handgrip portion 20 having a trigger guard part 22. A two part pump-operating handle 24 is received to slide lengthwise along the barrel portion of the case and is linked to a piston rod 26 of an air pump 28 by a shaft 30 that extends transversely through the case, extends laterally outwardly from within the case through guide slots 32 in the case sections (only one slot is shown) and has its respective ends held in sockets (not shown) in the respective halves of the handle on opposite sides of the barrel portion of the case.

When the user slides the handle back and forth along the barrel portion, the piston rod 26 moves a piston 34 through a cylinder member 36 of the pump, thereby pumping air into a reservoir 38 that is partly filled with water, thereby leaving room for pressurized air. The reservoir is a bottle having an externally threaded neck portion 38*a* and is joined to the case by screwing the neck into an internally threaded socket portion 40 of the case 10. The bottle is filled by removing it from the receptacle and is replaced on the case for use. Water in the reservoir maintained under air pressure by air pumped into it by operation of the pump is kept from being expelled by a normally closed discharge control valve 42, which forms part of a pump/valve subassembly of the water gun. When a trigger 44 is pulled by the user, the discharge control valve is opened, and water under pressure is conducted through a discharge tube 46 to and out of a nozzle 48.

Figure 3:
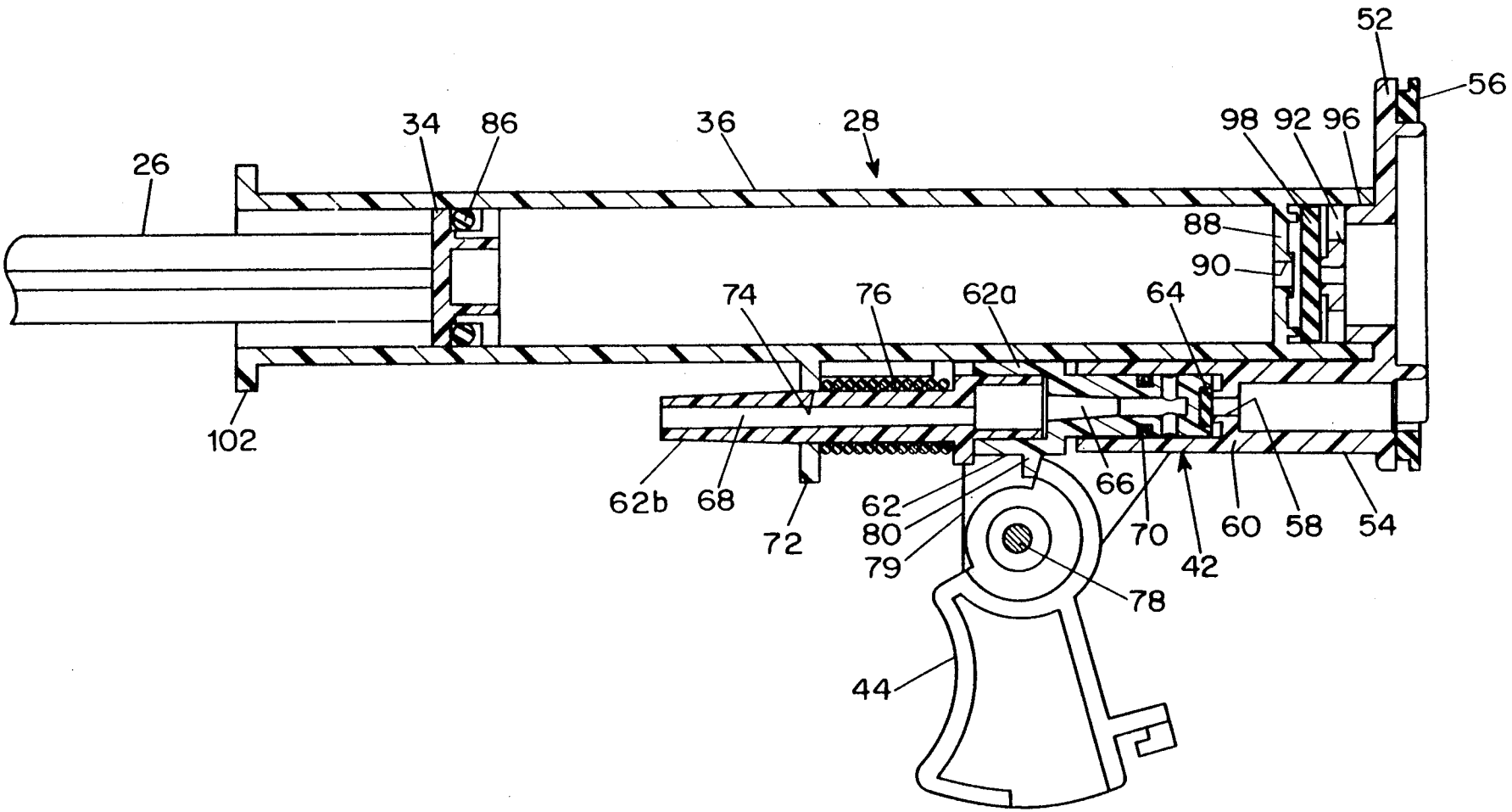
FIG. 3 is a side cross-sectional view of the pump-/valve subassembly of the embodiment.

Referring now to FIG. 3, the pump/valve sub-assembly comprises the pump 28 and the discharge control valve 42. A flange plate 52 affixed to the outlet end of the cylinder member 36 has an integral tubular boss portion 54 extending from it externally of the cylinder member outlet. The boss portion serves as the valve body of the discharge control valve 42. An annular gasket 56 on the perimeter of the flange plate laterally outwardly of the cylinder member and the boss portion forms a seal with the neck of the water reservoir ( see FIG. 1), and thus the air pump outlet to the water reservoir and the inlet to the discharge valve communicate directly with the reservoir.

The valve body (tubular boss portion 54) of the discharge valve has a valve port opening 58 defined by a valve seat 60 in the form of a transverse wall portion of the valve body. The discharge valve further includes a valve flow tube 62 slidably supported at one end portion in the valve body by reception telescopically within a portion thereof and carrying a flow tube gasket 64 at its end adapted to form a seal with the valve seat 60. To facilitate molding, the valve flow tube is made in two parts 62*a* and 62*b*. Part 62*a* is in clearance with the inner wall of the valve body 54 so that when it is moved away from the flange plate to unseat the gasket 64 from the seat 60, water under pressure from the reservoir 38 can flow in the annulus and through passages 66 and 68 and thence through the discharge tube 46, which is attached to the flow tube part 62*b* (see FIG. 1) An O-ring 70 seals off the annulus upstream from the passage openings in the tube part 62*a*.

A laterally extending valve tube support arm 72 having a guide hole 74 is attached (such as by molding it integrally) to the cylinder member 36. The valve flow tube part 62*b* is slidably supported in the guide hole of the support arm, and a compression spring 76 is engaged between the support arm and the valve flow tube and biases the valve flow tube in a direction to seat the flow tube gasket 64 on the valve seat 60. The trigger 44, which is pivotally mounted on a pin 78 received in a pair of arms 79 projecting from the cylinder member 36, engages a projecting lug 80 on the valve flow tube. When the user pulls the trigger, the valve flow tube 62 is displaced against the bias of the compression spring, thereby opening the discharge control valve. The discharge tube 46 is flexible and is trained through the barrel portion 12 of the case such that it has loops that readily deform when the valve flow tube is displace to open the discharge control valve. A flexible tube 82 having a metal fitting 84 on its end to weight the end down (see FIG. 1) to the lowermost part of the reservoir is connected to the passage in the valve body and conducts water under pressure from the reservoir when the gun is being "fired." It will be noted that the tube 82 is not subject to any pressure difference, so it need only be soundly attached to the discharge control valve mechanically but does not have to form a seal with the valve against a pressure difference.

The pump piston has a conventional O-ring type one-way seal 86. When the user pulls the piston toward the reservoir, movement of the O-ring is frictionally retarded by engagement with the cylinder wall and the O-ring seats on the land of the ring groove nearer the piston rod, and the air trapped in the cylinder member is pumped into the reservoir. When the piston is pushed away from the reservoir, the O-ring shifts away from the rod, thereby opening the clearance space between the piston and the cylinder wall and permitting air to be inducted into the cylinder chamber from the rod end through lengthwise slots in the piston.

The cylinder member 28 has a transverse wall 88 closely adjacent the outlet end. The transverse wall has a hole 90 in it to permit air to flow through it to the outlet end of the cylinder member. A seal retainer disc 92 is received in the cylinder member between the transverse wall 88 and is held in place in the cylinder member by an annular flange portion 96 on the flange plate 56. The retainer disc has openings to permit air to flow through it to the outlet end of the cylinder member. A flange valve diaphragm 98 is received between the transverse wall and the retainer disc and blocks the flow of air from the reservoir into the cylinder member through the hole in the transverse wall when the pump piston moves away from the outlet end of the cylinder member, thereby trapping the air pumped into the reservoir, and permits the flow of air under pressure from within the cylinder member through the hole in the transverse wall when the piston moves toward the outlet end of the cylinder member. The diaphragm is a flexible (soft) rubber disc and is loosely received in the space between the wall and retainer disc with clearance from the cylinder wall, through which the pumped air passes.

Figure 2:
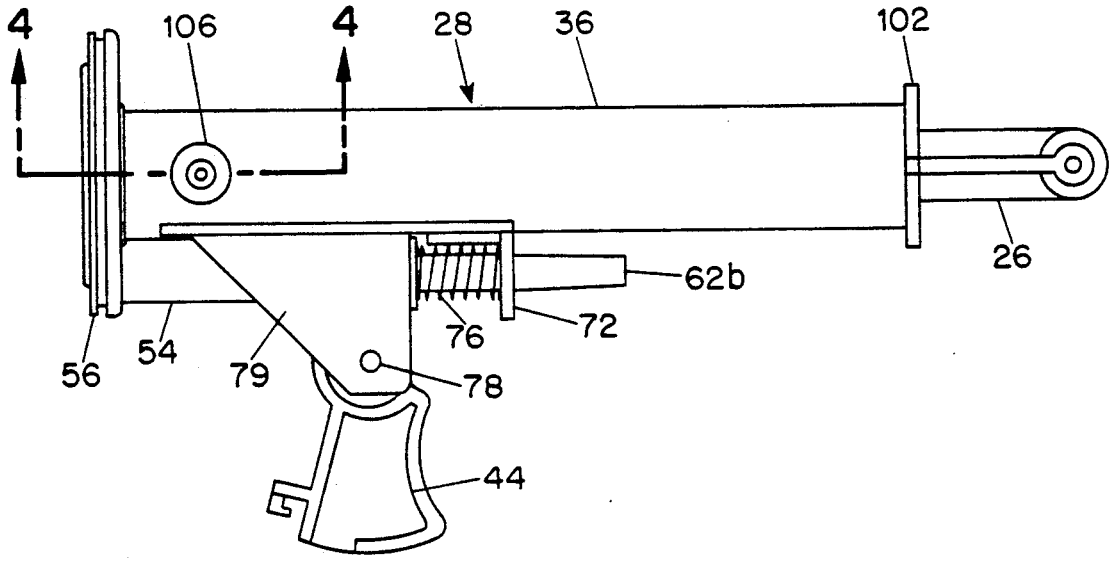
FIG. 2 is a side elevational view of the pump/valve subassembly of the embodiment.
Figure 4:
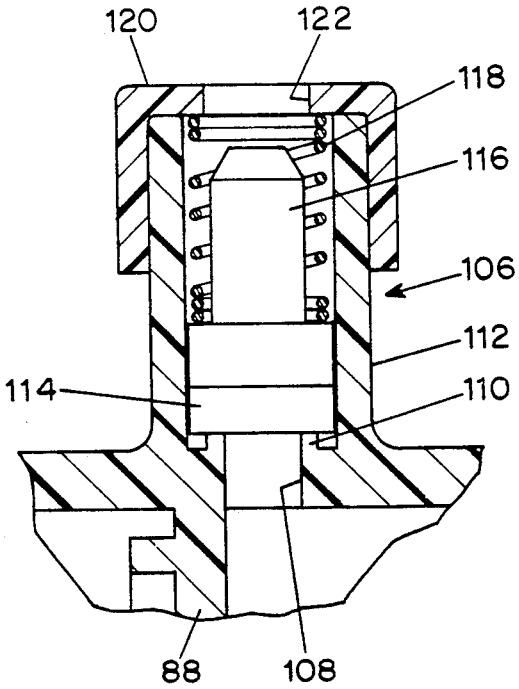
FIG. 4 is a detail cross-sectional view of the pressure-relief valve taken along the lines 4—4 of FIG. 2 and shown on an enlarged scale.

An optional but desirable feature of the water gun is a pressure-relief valve 106 communicating with the air pump cylinder member 36 proximate to the outlet end into the reservoir (FIG. 2) for preventing the pump from pressurizing the air pumped into the water reservoir to a pressure above a predetermined value. The pressure relief valve includes a port 108 in the cylinder member surrounded by a valve seat 110, an annular flange 112 surrounding the valve seat, a seal member in the form of a gasket 114 and a plunger 116, and a spring 118 biassing the seal member into sealing engagement with the valve seat and adapted to yield and enable the seal member to unseat from the valve seat when the pressure in the reservoir reaches the predetermined value. The spring is engaged between the plunger and a cap 120 that fits over the flange 112, is secured to the flange by an adhesive, and has a hole 122 for releasing water and air that is released by the valve. The cap 120 protrudes slightly through a hole (not shown) in the gun case 10. Any water that leaks into the pump cylinder from the reservoir is released by the valve 106 as a harmless spray, inasmuch as the hole 116 in the cap is large and the water is deflected by the seal as it exits the port. The skilled observer will see that most of the components of the pump/valve assembly can be injection-molded from suitable polymeric materials in simple two-part molds and that assembly is quick and easy. The diaphragm 98 and retainer 92 are inserted into the cylinder, and the valve flow tube part 62*b*, with the spring 76 in place, is inserted into the guide hole 74 of the arm 72. The O-ring 70 and gasket 60 are fitted to the valve flow tube part 62*a*, which is inserted into the valve body 54 of the flange plate. The flange plate 52 is then installed on the cylinder member 36 using an adhesive or chemical bonding agent between the flange portion 96 and the cylinder member to provide a strong mechanical connection and a seal. The tube 82 and the discharge tube 46 and nozzle can be attached to the pump/valve at this stage or at final assembly. In either case there is enough slack in the discharge tube to enable the nozzle 48 to be fitted to it before the case is assembled and then installed on the case with the telescoping relation shown in FIG. 1.

It will be seen (FIG. 1) that the pump/valve subassembly is held in position in the case by reception of the perimeter of the flange plate 52 in a groove 100 molded into the case halves and by reception of a flange 102 at the rod end of the cylinder member in a groove 104 in the case. The remaining aspects of the assembly of the gun need not be explained.

A light tension spring 106 biases the trigger against the lug 80 just so that it does not swing freely.

As mentioned above, the edge of the neck 38*a* of the reservoir is sealed air and water tight to the flange plate of the pump/valve by the gasket 56 when the reservoir is threaded onto the case. The direct coupling of the pump/valve to the reservoir is highly advantageous functionally and offers economies in manufacturing time and cost. It is not required, however, that the reservoir (bottle) be joined to the case by a threaded connection or that it be removable. It would be entirely suitable to fasten the reservoir to the case permanently and the provide a capped fill opening in the reservoir. Indeed, this approach has advantages in terms of filling convenience, since the gun remains fully assembled and a small cap is easier to reinstall than is the fairly large and heavy (when filled) reservoir, which has to be held upright, lest the water spill out and is prone to being dropped when being installed on the case. The advantage of the direct mating of the reservoir and the pump-/valve is applicable to a permanently attached reservoir.

I claim:

1. In a toy water gun including a hollow elongated case having a hand grip portion for grasping by a user, a water reservoir that has a neck and is attached to the case at the neck, an air pump having a cylinder member forming a chamber, a piston and piston rod received in the cylinder member, and a one-way valve on the piston, the air pump being mounted in the case and communicating through a one-way valve in an outlet end of the cylinder member with the water reservoir such that air under pressure can be pumped into the reservoir by operation of the air pump, a flexible discharge tube leading to a nozzle mounted on the case, and a normally closed discharge control valve interposed between the water reservoir and the discharge tube, the discharge control valve being operable to enable water to flow from the reservoir to and out of the nozzle, the improvements comprising a flange plate affixed to the outlet end of the cylinder member, an integral tubular boss extending from the flange plate externally of the cylinder member outlet end, the boss being a valve body of the discharge control valve, and an annular gasket on the perimeter of the flange plate laterally outwardly of the cylinder member and tubular boss forming a seal with the neck of the water reservoir, whereby the air pump outlet to the water reservoir through the one way valve and the inlet to the discharge control valve communicate directly with the reservoir.

2. The improvements according to claim 1 wherein the valve body of the discharge valve has a valve port opening defined by a valve seat, and the discharge control valve includes a valve flow tube slidably supported in the valve body by reception telescopically within a portion thereof and carrying a flow tube gasket adapted to form a seal with the valve seat.

3. The improvements according to claim 2 wherein a valve tube support arm having a guide hole is attached to the cylinder member, the valve flow tube is slidably supported in the guide hole of the support arm, and a compression spring is engaged between the support arm and the valve flow tube and biases the valve flow tube in a direction to seat the flow tube gasket on the valve seat.

4. The improvements according to claim 3 and further comprising a trigger engaging the valve flow tube and moveable to move the valve flow tube against the bias of the compression spring and thereby open the discharge valve.

5. The improvements according to claim 4 wherein the cylinder member has a transverse wall closely adjacent the outlet end, the transverse wall has a hole in it to permit air to flow through it to the outlet end of the cylinder member, wherein a seal retainer disc is received in the cylinder member between the transverse wall and the flange plate, the retainer disc has openings to permit air to flow through it to the outlet end of the cylinder member, the flange plate has an annular flange received within the outlet end of the cylinder member and engaging the retainer disc, and a flange valve diaphragm is received between the transverse wall and the retainer disc and blocks the flow of air from the reservoir into the cylinder member through the hole in the transverse wall when the pump piston moves away from the outlet end of the cylinder member and permits the flow of air from within the cylinder member through the hole in the transverse wall when the piston moves toward the outlet end of the cylinder member.

6. The improvements according to claim 1 and further comprising pressure-relief valve means communicating with the air pump cylinder member proximate to the outlet end for preventing the pump from pressurizing the air pumped into the water reservoir to a pressure above a predetermined value.

7. The improvements according to claim 6 wherein the pressure relief valve means includes a port in the cylinder member surrounded by a valve seat, an annular flange surrounding the valve seat, a seal member, and a spring biassing the seal member into sealing engagement with the valve seat and adapted to yield and enable the seal member to unseat from the valve seat when the pressure in the reservoir reaches the predetermined value.

* * * * *